US005924243A

United States Patent [19]

Polowinczak et al.

[11] Patent Number: 5,924,243

[45] Date of Patent: Jul. 20, 1999

[54] ROTOR FOR A SASH BALANCE BRAKE AND PIVOT PIN ASSEMBLY

[75] Inventors: Allen D. Polowinczak, Plainfield; Mark V. Murphy, Chicago; James G. Prete, Hinsdale, all of Ill.

[73] Assignee: Ashland Products, Inc., Lowell, Ind.

[21] Appl. No.: 08/891,654

[22] Filed: Jul. 11, 1997

Related U.S. Application Data

[63] Continuation-in-part of application No. 08/780,640, Jan. 8, 1997, abandoned.

[51] Int. Cl.[6] ..... E05D 15/22

[52] U.S. Cl. ..... 49/181; 49/446

[58] Field of Search ..... 49/181, 445, 446, 49/451; 16/193, 197

[56] References Cited

U.S. PATENT DOCUMENTS

| | | | |
|---|---|---|---|
| 3,482,354 | 12/1969 | Trout | 49/181 |
| 4,452,012 | 6/1984 | Deal | 49/181 |
| 4,610,108 | 9/1986 | Marshik | 49/181 |
| 4,718,194 | 1/1988 | FitzGibbon et al. | 49/181 |
| 4,930,254 | 6/1990 | Valentin | 49/181 |
| 5,127,192 | 7/1992 | Cross | 49/181 |
| 5,237,775 | 8/1993 | Hardy | 49/181 |
| 5,243,783 | 9/1993 | Schmidt et al. | 49/181 |
| 5,353,548 | 10/1994 | Westfall | 49/181 |
| 5,371,971 | 12/1994 | Prete | 49/181 |
| 5,414,960 | 5/1995 | O'Donnell | 49/181 |
| 5,632,117 | 5/1997 | Prete et al. | 49/181 |
| 5,669,180 | 9/1997 | Maier | 49/181 |
| 5,697,188 | 12/1997 | Fullick et al. | 49/181 |

*Primary Examiner*—Daniel P. Stodola
*Assistant Examiner*—Curtis A. Cohen
*Attorney, Agent, or Firm*—Wallenstein & Wagner, Ltd.

[57] ABSTRACT

A sash balance brake and pivot pin assembly for a sash window that maintains the window substantially square prior to installation. The pivot pin extends outwardly from the window sash. The sash balance brake is disposed within a track in the window frame and includes a rotor rotatably disposed within an expandable housing. The pivot pin has a collar for lateral engagement with the rotor to prevent the window frame from bowing away from the window sash, thereby maintaining the window frame substantially square. The rotor has a first slot and a transversely disposed second slot defining an inner surface. The inner surface includes an angled surface to resist breakage of the rotor when the window sash in installed into the window frame. The rotor also has a pair of flats at a first end to further resist breakage of the rotor when the pivot pin is positioned at an angle with respect to the rotor.

16 Claims, 4 Drawing Sheets

ROTOR FOR A SASH BALANCE BRAKE AND PIVOT PIN ASSEMBLY

This is a continuation-in-part Application of U.S. patent Appln. Ser. No. 08/780,640 filed Jan. 8, 1997, now abandoned.

DESCRIPTION

Technical Field

The present invention relates to a sash balance brake and pivot pin assembly for a pivotable sash window mounted in a frame that prevents the frame from bowing during shipment and installation and, more particularly, to a rotor used in the assembly that resists breakage during installation of the window sash into the frame.

BACKGROUND OF THE INVENTION

Pivotable sash window assemblies are well known in the art. Typically, these assemblies include a rotatable brake housing assembly actuated by rotation of a window sash pivot pin when the window sash is pivoted from its vertical position to a non-vertical position. The brake housing assembly locks the window sash relative to the window frame when the sash is pivoted, thereby preventing the sash from springing up due to the upward bias of the sash balance connected to the brake housing.

Typically, the window sashes, and associated balance and brake hardware, are pre-installed into a window frame to form the pivotable sash window assembly. The pivotable sash window assembly is then shipped for final installation into a house, building or other structure. During shipment and installation, vertical jambs of the window frame often bow, or deflect, away from the window sash. This bowing causes the pivot pins to dislocate from the brake assemblies allowing the window sashes to separate from the window frame. In the past, window manufacturers wrapped the window frame with metal bands or tape to prevent the frame from bowing during shipment. This, however, required additional materials and labor in preparing the sash window assembly for shipment.

U.S. Pat. No. 5,371,971, having the same assignee as the present invention, addresses this problem. U.S. Pat. No. 5,371,971 provides a simple, reliable sash balance brake and pivot pin assembly that secures a pivotable window sash in a window frame. The assembly prevents the vertical jambs of the frame from bowing out and distorting from the sash during shipment and installation, thus eliminating the need for wrapping the frames with metal bands or tape.

As disclosed in U.S. Pat. No. 5,371,971, a pair of sash balance brake and pivot pin assemblies are used for each window sash installed in the window frame. Specifically, the assembly includes a pivot pin extending outwardly from the window sash. The pivot pin has a collar extending radially outwardly around a circumference of the pivot pin. The assembly also includes a sash balance brake housing disposed within a track in the window frame. The brake housing is expandable and has an opening to rotatably support a rotor. The rotor has a first slot to receive the pivot pin. The rotor also has a second slot transversely disposed relative to the first slot and extending beyond the width of the first slot, thus defining an inner surface of the second slot. The pivot pin is inserted into the rotor from an opening in the top of the brake housing. The pivot pin is received by the first slot of the rotor while the collar on the pivot pin is simultaneously received by the second slot of the rotor. Once inserted, the collar engages the inner surface of the second slot preventing the pivot pin from moving laterally, or inwardly, relative to the brake housing. Because the window frame is attached to the track retaining the brake housing, the window frame is, therefore, prevented from bowing away from the window sash, thereby maintaining the window frame substantially square. While U.S. Pat. No. 5,371,971 utilized an expandable brake housing, the invention has also been utilized with brake housings that support a separate brake shoe.

The sash balance brake and pivot pin assembly of U.S. Pat. No. 5,371,971 has been very successful in preventing the window frame from bowing and distorting from the window sash. Window manufacturers have experienced a problem with the assemblies, however, when installing the window sash into the window frame, sometimes referred to as "racking the window sash." During installation, a portion of the rotor is occasionally cracked off the rotor.

To appreciate this problem, it is important to understand a typical installation procedure. When installing the window sash into the window frame, the brake housings retained in the tracks on each side of the window frame are horizontally aligned. A first pivot pin on one side of the sash is initially inserted into the rotor carried by the brake housing. The window sash is then necessarily positioned at an angle to properly align a second pivot pin with the rotor carried by the opposite brake housing. With the window sash positioned at this angle to allow insertion of the second pivot pin, the collar on the first pivot pin tends to engage and pry against the inner surface of the second slot of the rotor. This prying sometimes causes the portion of the rotor proximate the inner surface to crack off the rotor. The rotor must then be replaced in the brake housing, thus increasing material costs and installation time.

The present invention is provided to solve these and other problems.

SUMMARY OF THE INVENTION

It is an object of the invention to provide a sash balance brake and pivot pin assembly for a sash window which maintains the window substantially square prior to installation.

In accordance with the invention, a pivot pin extends outwardly from a window sash. A sash balance brake assembly is disposed within a track in a window frame and includes a rotor rotatably disposed within a brake housing. The pivot pin has a collar for lateral engagement with the rotor to prevent the window frame from bowing away from the window sash, thereby maintaining the window frame substantially square.

Specifically, the rotor has a body having a first slot dimensioned to receive the pivot pin, and a second slot transversely disposed relative to the second slot dimensioned to received the collar. The second slot extends beyond the first slot to define an inner surface. The inner surface includes a normal surface and an angled surface tapered from the normal surface outwardly towards a first end of the first slot to provide clearance for the pivot pin collar when the window sash is positioned at an angle during installation of the window sash into the window frame.

According to another aspect of the invention, the rotor has a flat at the first end. Preferably, the flat is comprised of a pair of flats, and the angled surfaces preferably extend to the flats.

Other features and advantages of the invention will be apparent from the following specification taken in conjunction with the following drawings.

DETAILED DESCRIPTION OF A PREFERRED EMBODIMENT

Figure 1:
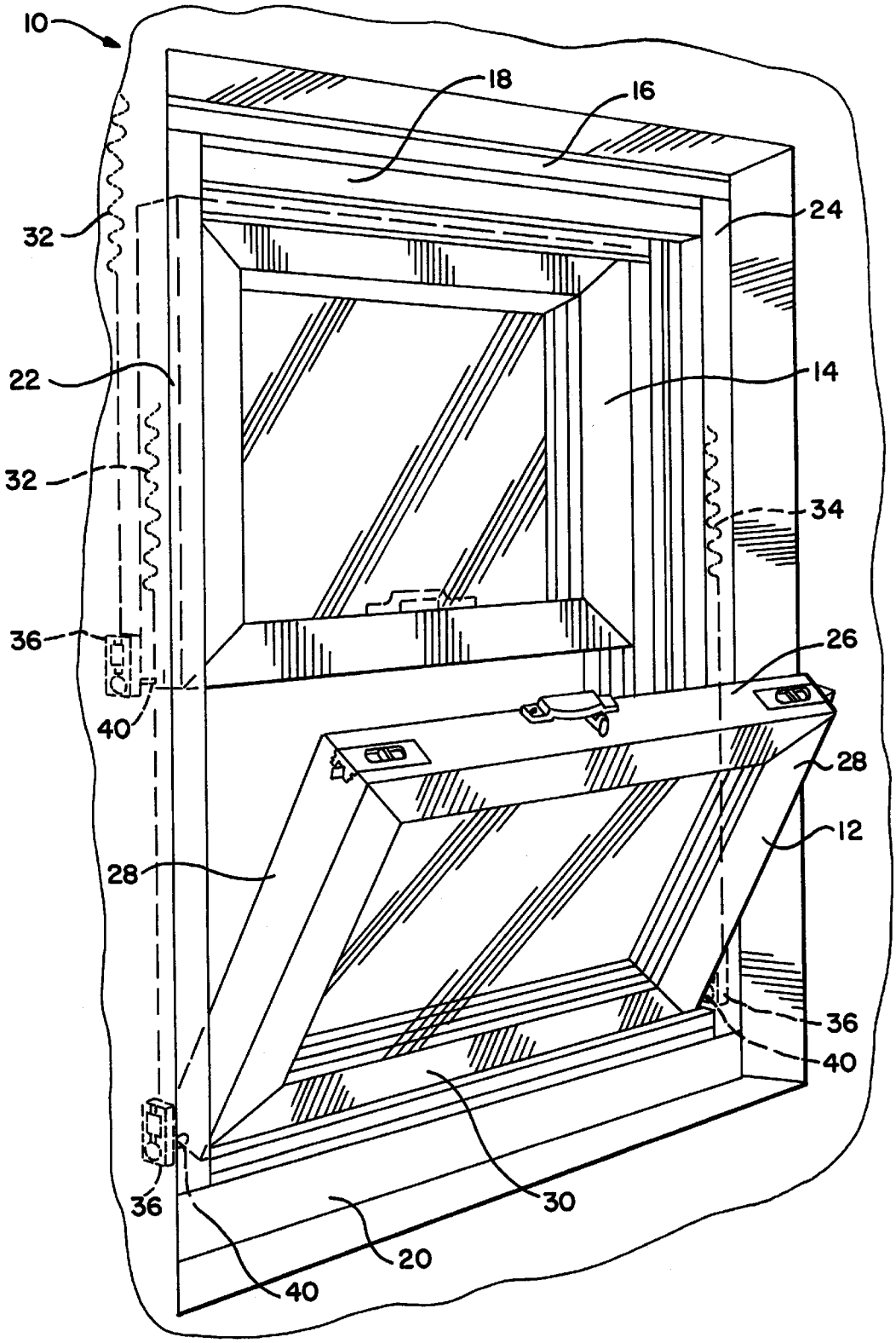
FIG. 1 is a perspective view of a double-hung window assembly including combination sash balance brake and pivot pin assemblies.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

A conventional pivotable double hung sash window system, generally designated 10, is disclosed in FIG. 1. As is well known, the window system 10 is vertically mounted in a conventional fashion in a wall or other similar structure. The window system 10 includes a lower sash 12 and an upper sash 14, reciprocally mounted within a window frame 16. The window frame 16 includes a header 18, a sill 20, a left jamb 22, and a right jamb 24. The lower sash 12 and upper sash 14 each include a sash top header 26, two opposing sash stiles 28 and a sash base 30. In general, the form of the sashes 12, 14 and jambs 22, 24 follows a conventional structure and form.

Figure 3:
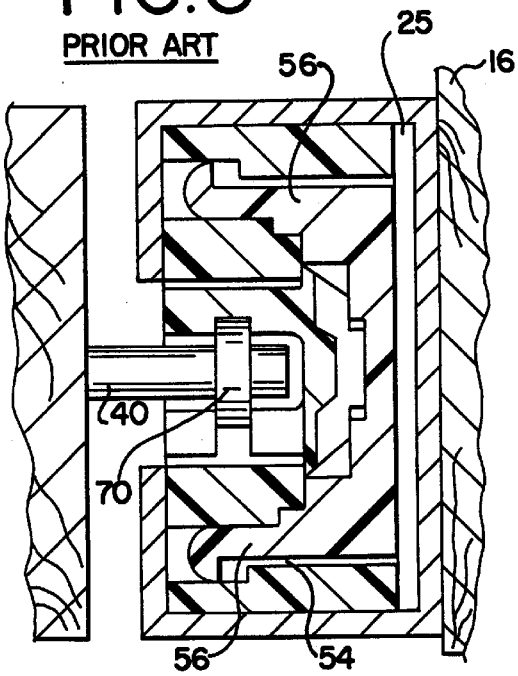
FIG. 3 PRIOR ART
FIG. 3 is a sectional view of the prior art sash balance brake and pivot pin assembly of FIG. 1, showing the assembly in a non-braking position.

As is well known, the window system 10 includes a pair of sash balances 32, 34 for each of the respective sashes 12, 14. The sash balances 32, 34 provide an upward force to counter the weight of the respective sashes 12, 14. Because the sashes 12, 14 are pivotable, brake assemblies 36 are provided. The brake assemblies 36 slide within tracks 25 in the window frame 16 (FIG. 3). A pair of opposing pivot pins 40, one extending outwardly from each side of each of the sashes 12, 14, engage each of the brake assemblies 36. Rotation of the pivot pins 40 upon pivoting of the sashes 12, 14 locks the brake assemblies 36, and hence disables the respective sash balances 32, 34, when the respective sashes 12, 14 are pivoted away from the vertical position.

As previously discussed, there has been a tendency for frame jambs to bow outwardly before window systems have been placed in a wall. In order to overcome this problem, the pivot pins 40 of the present invention are laterally secured to their respective brake assemblies 36, to prevent, or otherwise minimize, outward bowing of the window frame.

Figure 2:
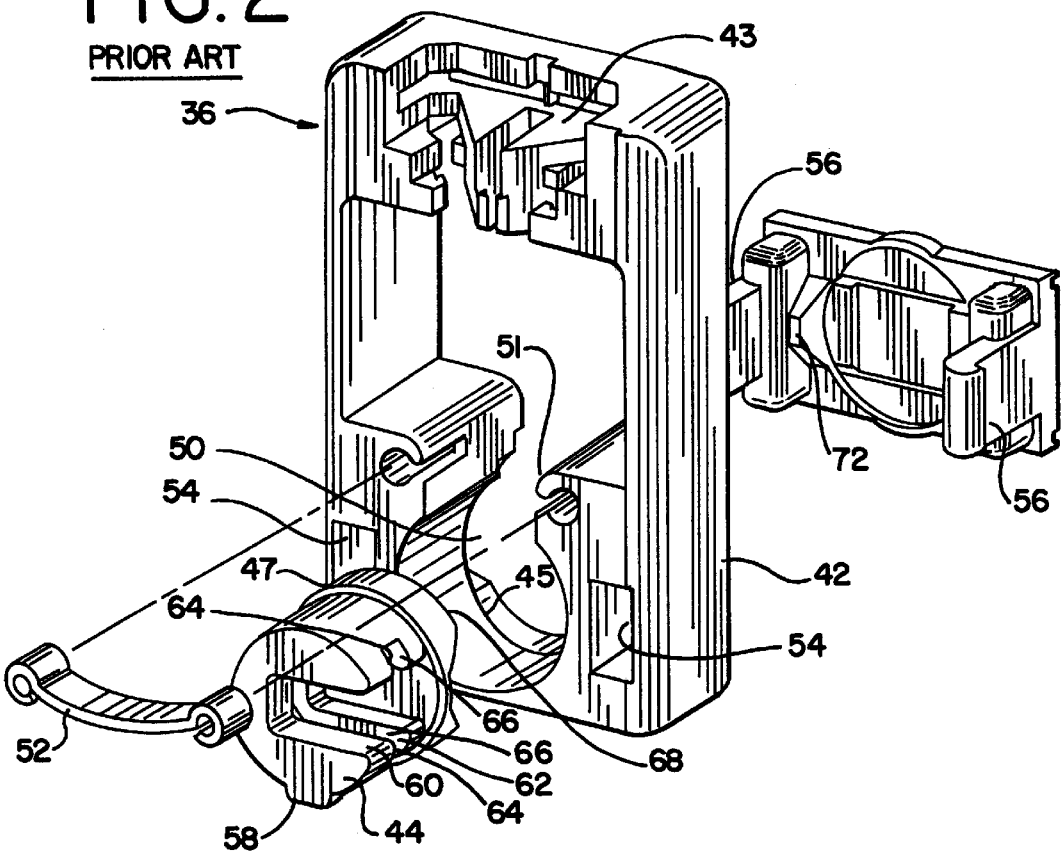
FIG. 2 PRIOR ART
FIG. 2 is an exploded perspective view of a prior art sash balance brake assembly.
Figure 4:
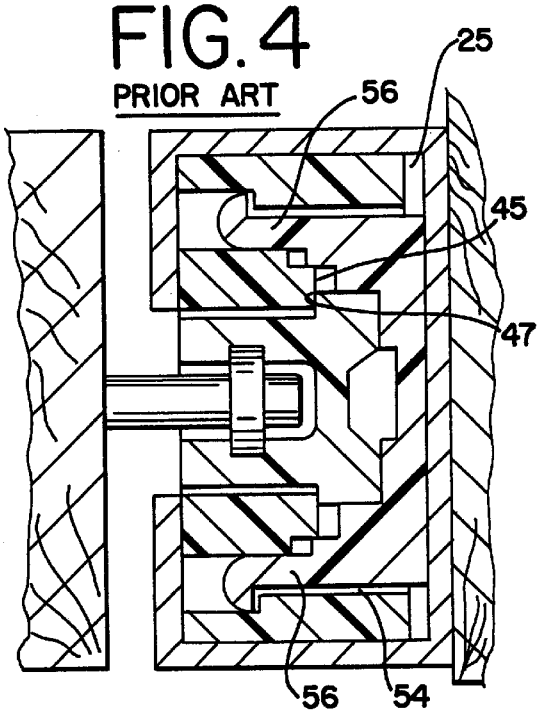
FIG. 4 PRIOR ART
FIG. 4 is a sectional view of the prior art sash balance brake and pivot pin assembly of FIG. 1, showing the assembly in a braking position.

FIGS. 2–4 show a prior art sash balance brake and pivot pin assembly in greater detail. This assembly is described in greater detail in co-pending, allowed U.S. patent application Ser. No. 08/372,563. As shown in FIG. 2, the brake assemblies 36 generally include a brake housing 42, a rotor 44 and a brake shoe 46.

As shown in FIG. 2, the brake housing 42 is a generally rectangular body and has a generally circular aperture 50 for receiving and rotatably supporting the rotor 44. The aperture 50 communicates with an upper opening 51. The housing 42 surrounds the rotor 44 to retain the rotor 44 within the aperture 50. The housing has a recessed surface 45 that cooperates with a ridge 47 on the rotor 44 to prevent the rotor 44 from moving inward relative to the housing 42. Alternatively, or in addition, the housing 42 can include a spring clip 52 to provide additional structure for retaining the rotor 44 in the brake housing 42. The brake housing 42 also has receiving structure 43 for connection to the sash balances 32, 34. The brake housing 42 further has a pair of openings 54 to support the brake shoe 46. Each opening 54 receives a leg 56 extending from the brake shoe 46.

As further shown in FIG. 2, the rotor 44 has a generally barrel-shaped body and has a generally U-shaped slot 58 extending axially in a direction corresponding to a longitudinal axis of the pivot pin 40. The first slot 58 is generally U-shaped and has an opening 60. The first slot 58 could also have other configurations depending on the shape of the pivot pin 40. The rotor 44 also has a second slot 62 transversely disposed relative to the first slot 58. The second slot 62 extends beyond the width of the first slot 58 defining a first pair of inner surfaces 64 confronting a second pair of inner surfaces 66. The rotor 44 also has camming surfaces 68 that cooperate with the brake shoe 46 to brake the assembly 36 to be described below.

Figure 9:
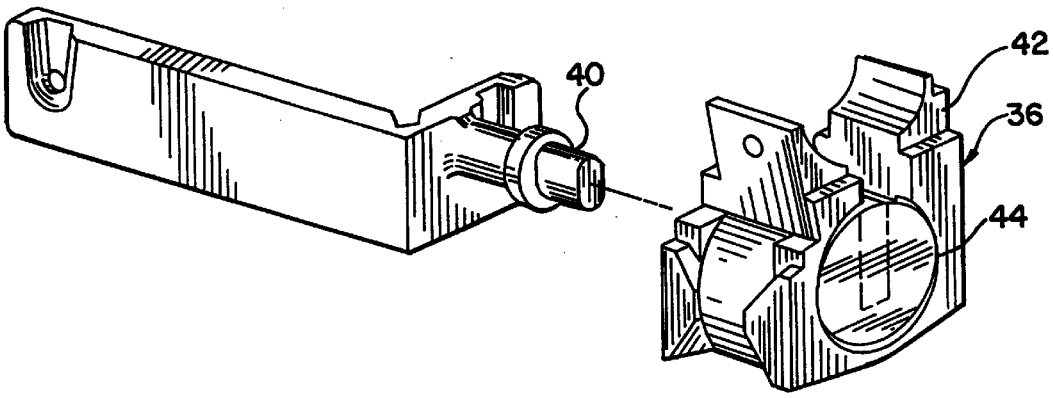
FIG. 9 is an exploded perspective view of another combination sash balance brake and pivot pin assembly that can be used with the present invention where the rotor is rotatably supported in an expandable brake housing.

The rotor 44 is conventionally attached to the window sashes 14, 16 via the pivot pin 40. It is appreciated that the pivot pin 40 can be integral with the window sash 14, 16, or part of a separate bracket that is secured to the window sash (FIG. 9). As shown in FIGS. 3 and 4, a collar 70 is circumferentially disposed about the pivot pin 40. The collar 70 can be square, oval, or such other configurations as would be retained by the rotor 44, but is preferably circular as shown. The pivot pin 40 is inserted into the rotor 44. The pivot pin 40 is received by the first slot 58 and the collar 70 is received by the second slot 62, which laterally secures the pivot pin 40 relative to the rotor 44 because the collar 70 engages the first inner surfaces 64. Thus, the pivot pin 40 is prevented from moving inwardly relative to the housing 42. Hence, because the pivot pin 40 is attached to the sashes 12, 14 and because the window frame 16 is attached to the track retaining the housing 60, the window frame 16 is prevented from moving outwardly relative to the sashes 12, 14, thus acting as an anti-bow means for preventing the window frame 16 from laterally bowing prior to being mounted.

Furthermore, as the pivot pin 40 is received by the first slot 58 of the rotor 44, rotation of the pivot pin 40 upon pivoting of the sashes 12, 14, rotates the rotor 44. Rotation of the rotor 44 causes the rotor camming surfaces 68 to cooperate with camming surfaces 72 located on the brake shoe 46, thus extending the brake shoe 46 from the housing 42 to thereby lock the housing 60 in its place and in its respective track 25 (FIG. 4).

When sashes 12, 14 are tilted a full 90 degrees, the sashes 12, 14 can easily be removed from the sash balance brake assemblies 36 because the opening 60 to the U-shaped cavity 58 will be aligned with the upper opening 51 of the housing 42, as will be appreciated from FIG. 2. However, when the sashes 12, 14 are pivotally in any other position, the collar 70 is retained in the rotor 44, so that the sashes 12, 14 cannot be removed.

As shown in FIG. 2, the first inner surfaces 64 are straight surfaces and are equidistant from the confronting second inner surfaces 66. As previously described, during installation of the window sashes 12, 14, the collar 70 of the pivot pin 40 tends to engage or pry against the inner surfaces 64 as there is little clearance between the collar 70 and the second slot 62 (FIGS. 3 and 4). This prying sometimes cracks the rotors 44. FIGS. 5–8 disclose a modified rotor in accordance with the present invention that addresses this problem. FIGS. 10–13 disclose another modified rotor in accordance with the present invention that also addresses this problem.

Figure 5:
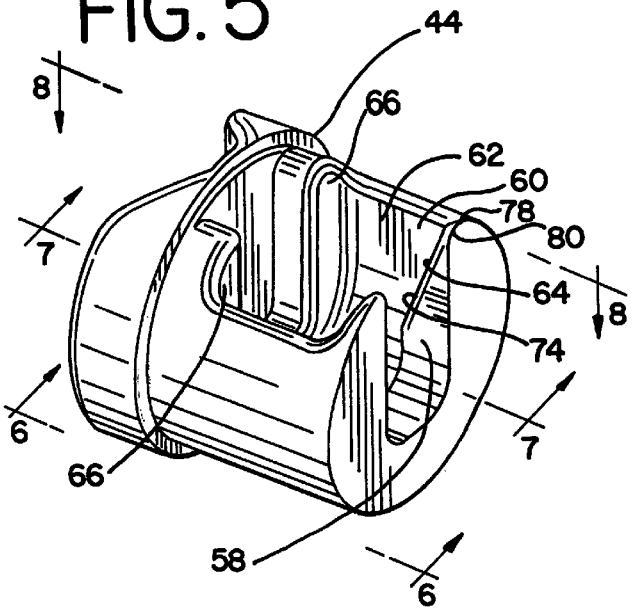
FIG. 5 is a perspective view of a rotor according to the present invention for use with the sash balance brake and pivot pin assembly of FIGS. 1 and 2.
Figure 6:
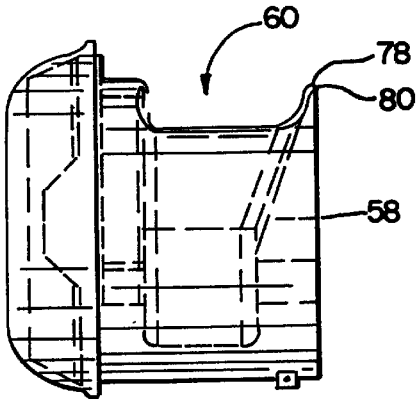
FIG. 6 is a front elevational view of the rotor of FIG. 5 taken from line 6—6 in FIG. 5.
Figure 7:
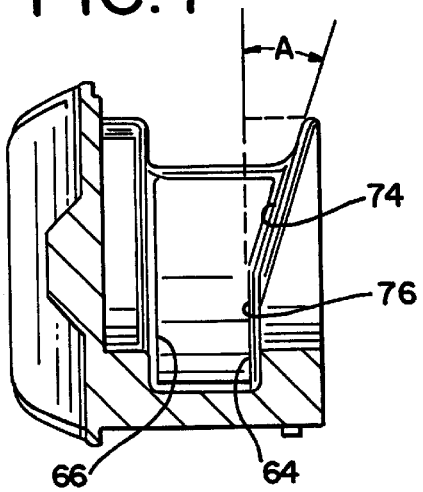
FIG. 7 is a cross-sectional view of the rotor of FIG. 5 taken along line 7—7 in FIG. 5; and, FIG. 8 is a plan view of the rotor of FIG. 5 taken from line 8—8 of FIG. 5.
Figure 8:
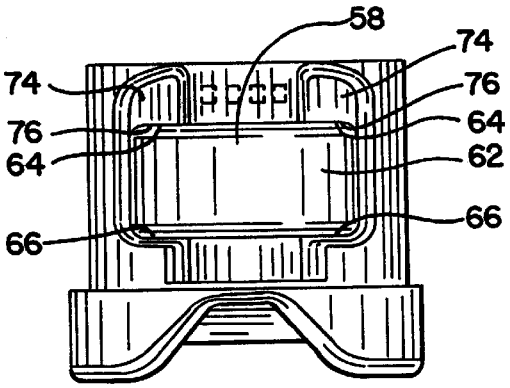

FIGS. 5 and 8 show the modified rotor having the first slot 58, second slot 62, first inner surfaces 64 and second inner surfaces 66. In accordance with the present invention, and as further shown in FIGS. 6 and 7, the second slot 62 is angled at one end. Specifically, at approximately a vertical midpoint along the first inner surface 64, the first inner surface 64 is beveled to form an angled surface 74. The first inner surface 64, therefore, has a normal surface 76 adjacent the angled surface 74. The inner surface 64 is tapered from the normal surface outwardly towards an outer end 78 of the opening 60, or towards a first end 80 of the first slot 58. As shown in FIG. 7, the angled surface 74 is tapered at an angle A formed from a vertical axis extending from a line collinear with the normal surface 76. As shown in FIG. 8, both first inner surfaces 64 are angled to form the angled surfaces 74. The specific angle A at which the angled surfaces 74 are tapered can vary. Preferably, the angled surface is tapered at an angle A of 19°.

This modified rotor 44 of FIGS. 5–8 will resist breakage during installation of the window sash into the window frame. As previously discussed, when installing the window sash, a pair of sash balance brake housings are horizontally aligned in opposing tracks in the window frame. The housings 42 each rotatably support a rotor 44. A first pivot pin connected to the window sash, such as the pivot pin 40, is inserted into one of the rotors 44. The first slot 58 receives the pivot pin 40 and the second slot 62 receives the collar 70 on the pivot pin 40. To insert the other pivot pin 40, the window sash is positioned at an angle to align the other pivot pin 40 with the other rotor. With the window sash positioned at an angle, the angled surfaces 74 provide additional clearance so that the collar 70 does not engage or pry on the first inner surface 64. If the angled surfaces 74 were not provided, such as with the straight inner surfaces 64 shown in FIG. 2 and depicted by the phantom lines in FIG. 7, the collar 70 would pry against the first inner surfaces 64. The angled surfaces 76 provide clearance to allow the collar 70 to rotate when the window sash is positioned at an angle. This provides a natural "lead-out" portion towards the opening 60 for the collar 70 and the pin 40. If the window sash is required to be positioned at too great an angle for proper alignment, the pin 40 will pop out of the rotor 100 via the opening 60 rather than prying on the inner surface 74 and eventually cracking the rotor 44. If the pivot pin 40 does pop out, it is an indication that the brake assemblies 36 are not horizontally aligned properly. Once aligned properly, both pivot pins 40 can be inserted into the rotors 44.

In addition, the present invention still maintains the structure necessary to prevent the window frame from bowing away from the window sashes. Once the window sash is installed in the window frame, the collars 70 will laterally engage the first inner surfaces 64 at the normal surfaces 76 preventing inward movement of the pivot pins 40 relative to the brake housings 42. Because the pivot pins 40 are attached to the window sash 12, 14 and because the window frame is attached to the channel retaining the brake housings 42, the window frame is prevented from moving outwardly relative to the window sashes, thus acting as an anti-bow means for preventing the window frame from laterally bowing prior to final installation.

It is appreciated that the length of the angled surfaces 74 can vary while still realizing the benefits of the present invention. For instance, the angle, or taper, does not necessarily have to start at a vertical midpoint along the inner surfaces 64. In addition, the actual angle A (FIG. 7) at which the angled surfaces 74 are tapered can also vary as described. It is further appreciated that the rotor 44 of FIGS. 5–8 can be used with the sash balance brake and pivot pin assembly shown in FIG. 9 which utilizes an expandable brake housing to rotatably support the rotor.

Figure 10:
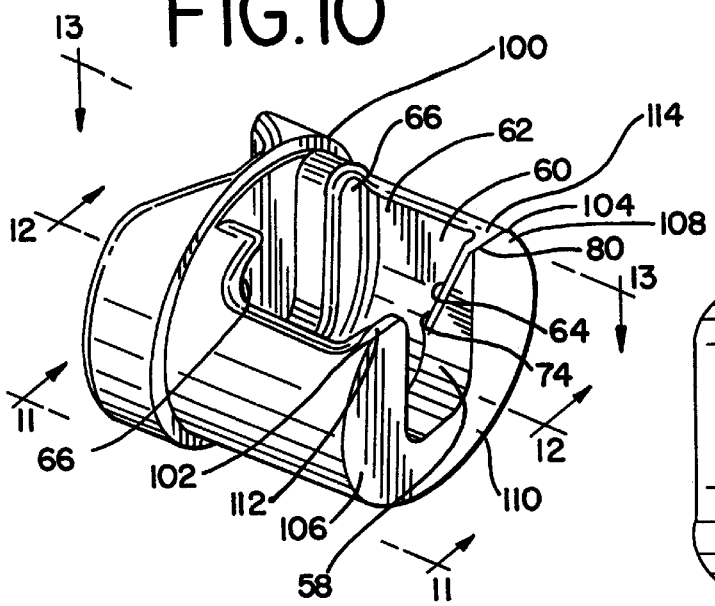
FIG. 10 is a perspective view of another embodiment of a rotor according to the present invention for use with the sash balance brake and pivot pin assembly of FIGS. 1 and 2.
Figure 11:
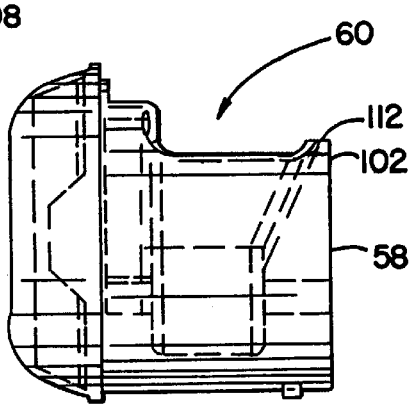
FIG. 11 is a front elevational view of the rotor of FIG. 10 taken from line 11—11 in FIG. 10.
Figure 12:
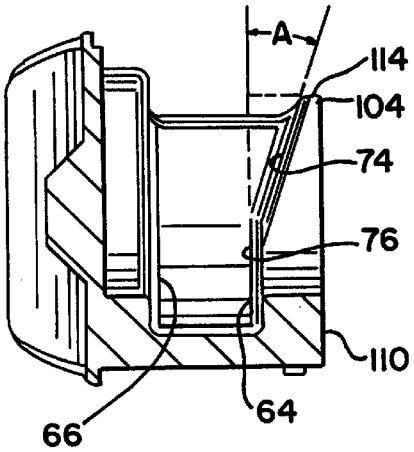
FIG. 12 is a cross-sectional view of the rotor of FIG. 10 taken along line 12—12 in FIG. 10; and, FIG. 13 is a plan view of the rotor of FIG. 10 taken from line 13—13 of FIG. 5.
Figure 13:
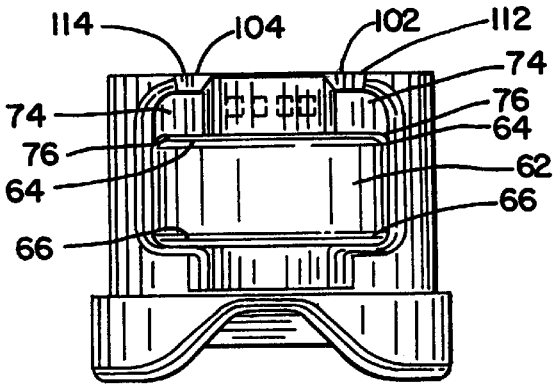

FIGS. 10–13 disclose another embodiment of a rotor 100 of the present invention. The rotor 100 is similar to rotor 44 in FIGS. 5–8 and like elements will be referred to with identical reference numerals. As shown in FIG. 10, the rotor 100 has a body and includes the first slot 58, second slot 62 and first inner surfaces 64. The first inner surfaces 64 also have angled surfaces 74. At the first end 80 of the first slot 58, the rotor body includes a first prong 102 and a second prong 104. The prongs 102,104 include the angled surfaces 74 on one side (facing second slot 62) and planar surfaces 106,108 on a face 110 of the rotor 100. The first and second prongs 102,104 partially define the first slot 58. As shown in FIGS. 10–12, the first prong 102 is reduced at its top end to form a first flat 112. Likewise, the second prong 104 is reduced at its top end to form a second flat 114. As shown in FIG. 10, the flats 112,114 are substantially horizontal surfaces. As shown in FIGS. 11 and 12, the angled surfaces 74 preferably extend to the flats 112,114.

The flats 112,114 provide additional clearance for the pivot pin 40 and, thus, an even larger "lead-out" portion towards the opening 60 for the collar 70 and the pin 40. This further reduces the chance that the collar 70 of the pin 40 will pry against the angled surfaces 74 of the inner surfaces 64 when the pin 40 is positioned at an angle such as when installing the window sash. With the flats 112,114, the pin 40 can pop-out of opening 60 of the rotor 100 rather than prying on the inner surfaces 64 and cracking the rotor 100. This can occur even if the brake assemblies 36 are not horizontally aligned.

In addition, when inserting the pins 40 into the rotors 100, the pins 40 can, on occasion, be only partially seated in the first and second slots 58,62. If the prongs 102,104 are not reduced to form the flats 112,114, and the pin 40 is positioned at an angle such as when installing the window sash, the collar 70 on the pin 40 may still engage and pry against the prongs 102,104. This could still crack the rotor 100 at the prongs 102,104. With the flats 112,114, however, the collar 70 does not pry against the prongs 102,104. Instead, the pin 40 rolls over the flats 112,114 out of the opening 60 without cracking the rotor 100.

As discussed, the present invention prevents the rotors 44,100 from cracking during installation of the window sash. The invention also functions any time the window sash, and therefore the pivot pins 40 and collars 70, are positioned at an angle such as when removing the window sash from the window frame 16.

It will be understood that the invention may be embodied in other specific forms without departure from the spirit or central characteristics thereof. The present examples and embodiments, therefore, are to be considered in all respects as illustrative and not restrictive, and the invention is not to be limited to the details given herein.

We claim:

1. A rotor for a sash balance brake and pivot pin assembly, the assembly including a brake housing for rotatably supporting the rotor and further including a pivot pin having a collar extending radially outwardly about a circumference of the pivot pin, the rotor comprising:

a cylindrical body having a first slot adapted to receive the pivot pin, the first slot having a first end, and a second slot transversely disposed relative to the first slot, the second slot adapted to receive the collar, the second slot extending beyond a width of the first slot and defining an inner surface, the inner surface including a normal surface and an angled surface, wherein the normal surface is parallel to an end face of the rotor, and wherein the angled surface is tapered from the normal surface outwardly towards the end face of the rotor.

2. The rotor of claim 1 wherein an acute angle is formed between an axis extending from a line collinear with the normal surface and the angled surface.

3. The rotor of claim 1 wherein the inner surface includes a pair of inner surfaces, each having a normal surface parallel to the end face of the rotor and an angled surface tapered from the normal surface outwardly towards the end face of the rotor.

4. A rotor for a sash balance brake and pivot pin assembly, the assembly including a brake housing for rotatably supporting the rotor and further including a pivot pin having a collar extending radially outwardly about a circumference of the pivot pin, the rotor comprising:

a cylindrical body having a first slot adapted to receive the pivot pin, and a second slot transversely disposed relative to the first slot, the second slot adapted to receive the collar, the second slot extending beyond a width of the first slot and defining a pair of inner surfaces, each inner surface further including a normal surface and an angled surface, wherein the normal surface is parallel to an end face of the rotor, and wherein the angled surface is tapered from the respective normal surface outwardly towards the and face of the rotor.

5. A sash balance brake and pivot pin assembly for a sash window system for mounting in a wall, the sash window system including a frame having two opposing tracks, a pair of sash balances, one disposed in each of said tracks, and a window sash for reciprocal movement along the tracks, the sash balance brake and pivot pin assembly for maintaining the frame substantially square relative to the window sash prior to mounting the frame into the wall, the sash balance brake and pivot pin assembly comprising:

a pair of opposed pivot pins adapted to extend laterally from opposing sides of the window sash, each pivot pin having a collar extending radially outwardly about a circumference of the pivot pin;

a pair of sash balance brake housings, one adapted to be coupled to a respective one of each of the sash balances along each of the respective ones of the tracks;

a pair of cylindrical rotors, one rotor rotatably supported in each sash balance brake housing, each rotor having a first slot adapted to receive one of the pivot pins, the first slot having a first end, the rotor further having a second slot transversely disposed relative to the first slot and adapted to receive the collar of the respective pivot pin, the second slot extending beyond a width of the first slot to define an inner surface, the inner surface having a normal surface and an angled surface, wherein the normal surface is parallel to an end face of the rotor, and wherein the angled surface is tapered from the normal surface outwardly towards the end face of the rotor, the angled surface adapted to provide clearance for the collar when the window sash is positioned at an angle during installation of the window sash into the window frame.

6. A combination sash balance brake and pivot bracket assembly comprising:

a sash balance brake unit and a pivot pin means; said sash balance brake unit including a brake and a cam mounted in an opening in said brake, said cam being rotatable about an axis, said cam having a first, axially extending slot therein having a first end, said first slot being smaller in a first direction horizontally transverse to said axis than in a second direction vertically transverse to said axis, said pivot pin being substantially equal in dimension to said slot in said first direction and larger than said slot in said second direction whereby rotary movement of said pivot pin about said axis in an arc from a first position to a second position causes said cam to rotate in a corresponding arc between a first position and a second position, said cam being configured relative to said opening whereby said cam causes said brake to have a greater outer dimension in said first direction when said cam is in said second position than when said cam is in said first position;

said pivot pin having an integrally formed collar circumferentially disposed and radially extending from the outer surface thereof, said cam having a second slot extending in said first direction transverse to the axis of and extending beyond the dimension of said first slot to define an inner surface, said pivot pin collar being vertically received in said second slot whereby said collar cannot move axially relative to said second slot, the inner surface further including a normal surface and an angled surface, wherein the normal surface is parallel to an end face of the cam, and wherein the angled surface is tapered from the normal surface outwardly towards the end face of the rotor to provide clearance for the collar when the window sash is positioned at an angle during installation of the window sash into the window frame.

7. A rotor for a sash balance brake and pivot pin assembly, the assembly including a brake housing for rotatably supporting the rotor and further including a pivot pin having a collar extending radially outwardly about a circumference of the pivot pin, the rotor comprising:

a cylindrical body having a first slot adapted to receive the pivot pin, the first slot having a first end, and a second slot transversely disposed relative to the first slot, the second slot adapted to receive the collar, the second slot extending beyond a width of the first slot to define an inner surface, the inner surface including a normal surface and an angled surface, wherein the normal surface is parallel to the end face of the rotor, and wherein the angled surface is tapered from the normal surface outwardly towards the end face of the rotor, the body having a flat at the first end.

8. The rotor of claim 7 wherein an acute angle is formed between an axis extending from a line collinear with the normal surface and the angled surface.

9. The rotor of claim 7 wherein the inner surface includes a pair of inner surfaces, each having a normal surface parallel to the end face of the rotor and an angled surface tapered from the normal surface outwardly towards the end face of the rotor.

10. The rotor of claim 7 wherein the flat further comprises a first flat and a second flat.

11. The rotor of claim 10 wherein the inner surface includes a pair of inner surfaces, each having a normal surface and an angled surface tapered from the normal surface towards the first end, the angled surfaces extending to the flats.

12. A rotor for a sash balance brake and pivot pin assembly, the assembly including a brake housing for rotatably supporting the rotor and further including a pivot pin having a collar extending radially outwardly about a circumference of the pivot pin, the rotor comprising:

a cylindrical body having a first slot adapted to receive the pivot pin, the first slot having a first end, and a second slot transversely disposed relative to the first slot, the second slot adapted to receive the collar, the second slot extending beyond a width of the first slot and defining a pair of inner surfaces, each inner surface further including a normal surface and an angled surface, wherein the normal surface is parallel to an end face of the rotor and wherein the angled surface is tapered from the respective normal surface outwardly towards the end face of the rotor, the body having a first flat and a second flat at the first end wherein the angled surfaces extend to the flats.

13. A sash balance brake and pivot pin assembly for a sash window system for mounting in a wall, the sash window system including a frame having two opposing tracks, a pair of sash balances, one disposed in each of said tracks, and a window sash for reciprocal movement along the tracks, the sash balance brake and pivot pin assembly for maintaining the frame substantially square relative to the window sash prior to mounting the frame into the wall, the sash balance brake and pivot pin assembly comprising:

a pair of opposed pivot pins adapted to extend laterally from opposing sides of the window sash, each pivot pin having a collar extending radially outwardly about a circumference of the pivot pin;

a pair of sash balance brake housings, one adapted to be coupled to a respective one of each of the sash balances along each of the respective ones of the tracks;

a pair of rotors, one rotor rotatably supported in each sash balance brake housing, each rotor having a first slot adapted to receive one of the pivot pins, the first slot having a first end, the rotor further having a second slot transversely disposed relative to the first slot and dimensioned to be adapted to receive the collar of the respective pivot pin, the second slot extending beyond the first slot to define an inner surface, the inner surface having a normal surface and an angled surface, wherein the normal surface is parallel to an end face of the rotor and wherein the angled surface is tapered from the normal surface outwardly towards the end face of the rotor, and a flat at the first end, the angled surface and flat adapted to provide clearance for the collar when the window sash is positioned at an angle.

14. A combination sash balance brake and pivot bracket assembly comprising:

a sash balance brake unit and a pivot pin means; said sash balance brake unit including a brake and a cam mounted in an opening in said brake, said cam being rotatable about an axis, said cam having a first, axially extending slot therein having a first end, said first slot being smaller in a first direction horizontally transverse to said axis than in a second direction vertically transverse to said axis, said pivot pin being substantially equal in dimension to said slot in said first direction and larger than said slot in said second direction whereby rotary movement of said pivot pin about said axis in an arc from a first position to a second position causes said cam to rotate in a corresponding arc between a first position and a second position, said cam being configured relative to said opening whereby said cam causes said brake to have a greater outer dimension in said first direction when said cam is in said second position than when said cam is in said first position;

said pivot pin having an integrally formed collar circumferentially disposed and radially extending from the outer surface thereof, said cam having a second slot extending in said first direction transverse to the axis of and extending beyond the dimension of said first slot to define an inner surface, said pivot pin collar being vertically received in said second slot whereby said collar cannot move axially relative to said second slot, the inner surface further including a normal surface and an angled surface, wherein the normal surface is parallel to an end face of the rotor, and wherein the angled surface is tapered from the normal surface outwardly towards the end face of the rotor, the angled surface extending to a flat at the first end, the angled surface and flat providing clearance for the collar when the window sash is positioned at an angle.

15. A rotor for a sash balance brake and pivot pin assembly, the assembly including a brake housing for rotatably supporting the rotor and further including a pivot pin having a collar extending radially outwardly about a circumference of the pivot pin, the rotor comprising:

a cylindrical body having a first slot adapted to receive the pivot pin, the first slot having a first end, and a second slot transversely disposed relative to the first slot, the second slot adapted to receive the collar, the second slot extending beyond a width of the first slot and defining an inner surface, the inner surface including an angled surface, wherein the angled surface is tapered with respect to a second inner surface of the second slot outwardly towards the end face of the rotor.

16. The rotor of claim 15 wherein the inner surface further includes a normal surface adjacent the angled surface, wherein the normal surface is parallel to an end face of the rotor, and wherein the angled surface is tapered from the normal surface outwardly towards the end face of the rotor.

* * * * *

UNITED STATES PATENT AND TRADEMARK OFFICE

CERTIFICATE OF CORRECTION

PATENT NO. : 5,924,243
DATED : July 20, 1999
INVENTOR(S) : Allen D. Polowinczak, Mark V. Murphy and James G. Prete

It is certified that error appears in the above-identified patent and that said Letters Patent is hereby corrected as shown below:

In Column 7, Line 55, replace the word "and" with the word "end".

Signed and Sealed this

Sixth Day of June, 2000

*Attest:*

Q. TODD DICKINSON

*Attesting Officer*

*Director of Patents and Trademarks*